US006802545B2

(12) United States Patent
Subliskey

(10) Patent No.: US 6,802,545 B2
(45) Date of Patent: Oct. 12, 2004

(54) WINDOW SASH LOCK KEEPER

(75) Inventor: Edward J. Subliskey, Mountain Top, PA (US)

(73) Assignee: Truth Hardware Corporation, Owatonna, MN (US)

( * ) Notice: Subject to any disclaimer, the term of this patent is extended or adjusted under 35 U.S.C. 154(b) by 369 days.

(21) Appl. No.: 09/742,205

(22) Filed: Dec. 20, 2000

(65) Prior Publication Data

US 2001/0003856 A1 Jun. 21, 2001

Related U.S. Application Data

(60) Provisional application No. 60/172,886, filed on Dec. 20, 1999.

(51) Int. Cl.[7] ..... E05B 15/02
(52) U.S. Cl. ..... 292/340; 52/204.7
(58) Field of Search ..... 292/340, 341.12, 292/341.14, 431.18; 52/213, 204.5, 204.55, 204.56, 204.62, 204.7

(56) References Cited

U.S. PATENT DOCUMENTS 1,390,436 A * 9/1921 Harlev ..... 292/340
2,531,256 A * 11/1950 Clasen ..... 292/340
3,310,927 A * 3/1967 Persson ..... 52/204.591
3,469,877 A * 9/1969 Hutchison ..... 292/341.18
4,525,952 A * 7/1985 Cunningham ..... 292/340
5,787,657 A * 8/1998 Librande et al. ..... 160/369

OTHER PUBLICATIONS

Drawing No. 9891 entitled "Keeper," by Allen–Stevens Corp., dated Apr. 5, 1994.

* cited by examiner

*Primary Examiner*—Anthony Knight
*Assistant Examiner*—Michael Wayne White
(74) *Attorney, Agent, or Firm*—Lorusso Loud & Kelly LLP

(57) ABSTRACT

An improved window sash lock keeper is provided having a slot to provide clearance for a burr, which is typically found on a surface upon which such a sash lock keeper is mounted. The improved keeper is typically mounted flush to a surface of an extruded window component. The clearance slot allows the keeper to be mounted with improved precision and thereby reduces interferences caused by misaligned window hardware.

20 Claims, 2 Drawing Sheets

WINDOW SASH LOCK KEEPER

CROSS-REFERENCE TO RELATED APPLICATIONS

This application claims the benefit of U.S. Provisional Application No. 60/172,886, filed Dec. 20, 1999.

STATEMENT REGARDING FEDERALLY SPONSORED RESEARCH OR DEVELOPMENT

Not Applicable

BACKGROUND OF THE INVENTION

The present invention relates to window hardware and more particularly to window sash lock hardware and still more particularly to window sash lock keepers.

Common window sash and rail materials include extruded polymer rails having intricate cross sections, which are designed to accept weather striping, glass and internal reinforcement members. Typical window sash extrusions comprise an exterior surface having slots or protrusions which mate with slots or protrusions in a complementary window rail extrusion when the complementary extrusions are placed in mating proximity to each other, for example by closing a window.

It is well known to employ a manual window sash lock in combination with a keeper to secure a window in a closed position. A moveable locking arm mechanism is typically mounted to a first window extrusion by mechanical fasteners, typically screws, and a keeper is typically mounted to a mating second window extrusion by mechanical fasteners, typically screws, so that the moveable locking arm is positioned to capture the keeper when the window is closed.

It is known that a first window extrusion having a sash lock mounted thereto must be closely aligned to a second window extrusion having a keeper mounted thereto in order for the sash lock to properly capture the keeper. Sash locks and keepers are designed with close clearances to prevent even small relative movements therebetween so that windows are tightly secured when a lock arm engages a keeper. Even small misalignments between a sash lock and a keeper may cause a mechanical interference, which prevents proper motion of a lock arm or proper closing of a window.

It is known that segments of protrusions, which extend from window sash and rail extrusions, are typically cut away in order to provide a flat surface to which a window sash lock keeper may be installed. Corresponding segments of protrusions, which extend from the mating extrusion, are typically cut away to provide clearance for a sash lock keeper when a window is closed. Often machining or cutting operations used to remove protrusions from an extrusion leave a residual protrusion of material or burr on the extrusion surface. Typical sash lock keepers that are mounted to an extrusion surface having a residual protrusion or burr are prevented by the residual protrusion or burr from properly abutting the extrusion surface. Sash lock keepers are often thereby misaligned and cause potential interference with sash lock hardware or a mating extrusion.

SUMMARY OF THE INVENTION

Accordingly, the present invention relates to window sash lock keepers having a back surface wherein a linear clearance slot is disposed along the back surface to accept a residual protrusion or burr when the sash lock keeper is mounted to a window sash or rail extrusion.

Common window locking hardware comprises a sash lock and a keeper. The sash lock is typically mounted to a window extrusion rail by a pair of self-tapping screws. The sash lock typically comprises a moveable handle in mechanical communication with a latch arm so that motion of the handle causes some motion of the latch arm. A keeper is typically mounted by a pair of sheet metal screws to a corresponding location on a mating extrusion so that the keeper is located closely adjacent to the sash lock when the window is closed.

A window sash lock keeper comprises a bar of generally solid material having a thickness and at least one through-hole to receive at least one mounting screw. A part of the bar is shaped to form at least one beam capable of being overlapping engaged with at least one moveable latch arm of a sash lock when said keeper is mounted to a window extrusion, the sash lock is mounted at a corresponding location in the mating extrusion and the window is closed so that the extrusions are disposed in close mutual proximity. A window extrusion having a keeper and a corresponding window extrusion having a sash lock define a relative latch path wherein a sash lock arm and/or keeper are constrained to travel as the window is opened and closed. The overlapping engagement of a sash lock arm relative to said at least one beam causes a mechanical interference in the relative latch path, which prevents relative motion of the sash lock and keeper in a window opening direction and thereby prevents relative motion of the mating extrusions in a window opening direction.

Certain extrusions are modified to provide a flat surface area where a keeper may be mounted. Variations in manufacturing processes used to so modify the extrusions often leave a residual protrusion where a section of a linear protrusion has been largely removed. The keeper according to the present invention comprises a back side having at least one slot wherein said at least one slot has a depth that is sufficient to accept most typical residual protrusions in particular window extrusions. Said at least one slot is designed to align with and provide clearance for the residual linear protrusions thereby allowing said back surface of said keeper to lie flat against a flat surface of a window extrusion.

It is to be understood that various changes can be made by one skilled in the art in one or more of the several parts of the invention described herein without departing from the scope of the invention.

DESCRIPTION OF THE PREFERRED EMBODIMENT

Figure 3:
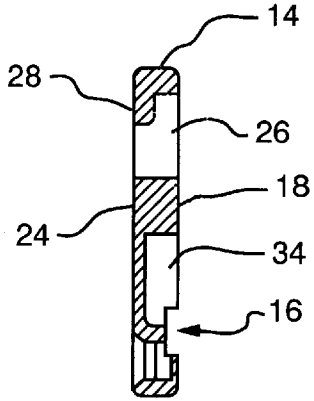
FIG. 3 discloses a sectioned side view of a keeper according to at least one embodiment of the present invention.
Figure 2:
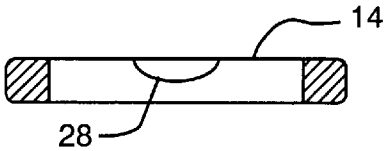
FIG. 2 discloses a sectioned front view of a keeper beam according to at least one embodiment of the present invention.
Figure 1:
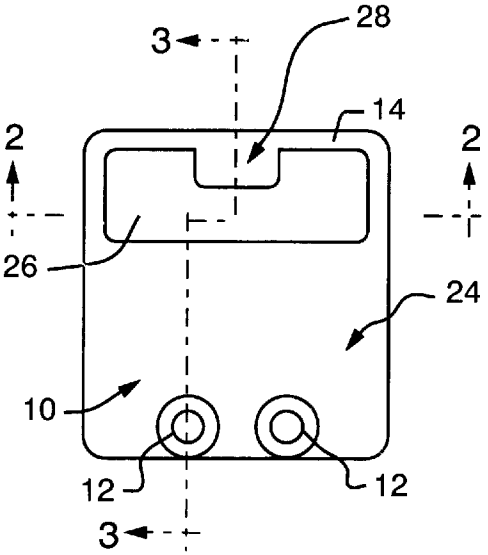
FIG. 1 discloses a top plan view of a keeper according to at least one embodiment of the present invention.
Figure 6:
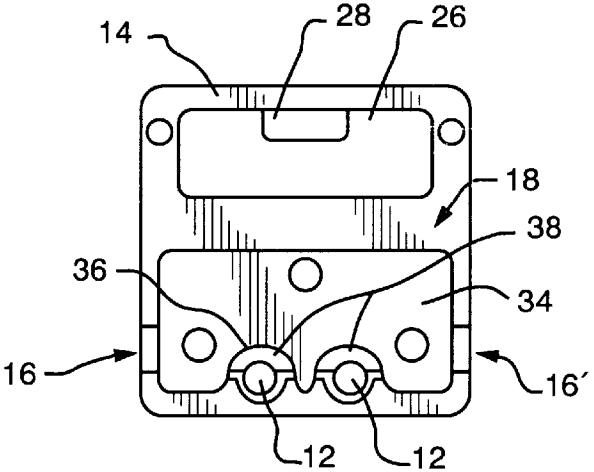
FIG. 6 discloses a bottom plan view of a keeper according to at least one embodiment of the present invention.
Figure 5:
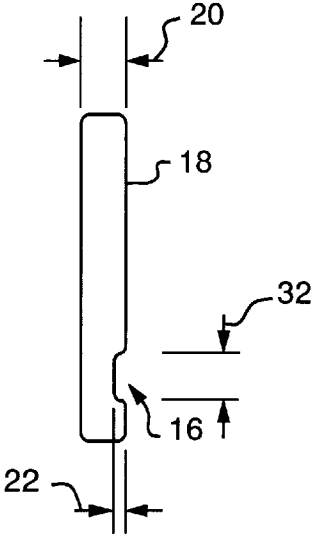
FIG. 5 discloses a side view of a keeper according to at least one embodiment of the present invention.
Figure 4:
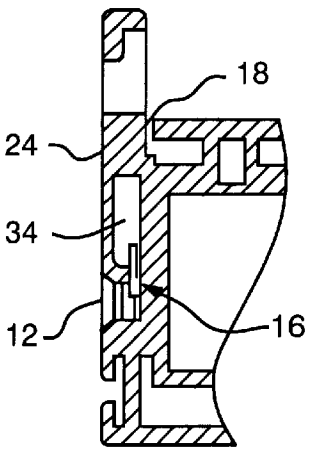
FIG. 4 discloses a sectioned side view of a keeper that is mounted to an extrusion according to at least one embodiment of the present invention.

Referring to FIGS. 1 and 5 of the drawing, a keeper 10 according to at least one embodiment of the present invention can be seen. The keeper 10 may be composed of any number of resilient solid materials having a thickness 20 and mechanical dimensions which are chosen to provide adequate strength and size to secure a typical window. Mounting screw through holes 12 are shown which may be tapered or countersunk as is common in the hardware arts to accept fasteners wherein the head of a fastener may be disposed flush to or below a front surface 24 upon installation of the fasteners. In the preferred embodiment, a keeper 10 comprises a metal alloy casting of generally rectangular shape having a thickness 20 of about 0.190 inches and two mounting screw through holes 12.

The keeper further comprises a beam 14 having a shape and mechanical dimensions which are chosen to form a structure which is capable of being captured by a latch arm of a mating sash lock when the sash lock and keeper are mounted to aligned positions on a mating pair of window extrusions.

Referring to FIGS. 1–4 and 6, a preferred embodiment of the present invention comprises a beam 14 which is formed at least in part by material surrounding a perimeter of a generally rectangular cavity 26 wherein said generally rectangular cavity 26 extends completely through said thickness 20. The beam 14 may further comprise protrusions or contours which are tapered to cooperate as a lead-in with a taper or contour on a latch arm of a mating sash lock.

In the preferred embodiment, the beam 14 further comprises a protrusion 28 having dimensions and shape chosen so that the protrusion 28 is capable of being captured or surrounded on all free sides by a sash lock having a curved latch arm and a rotational latch trajectory which extends through the generally rectangular cavity 26 around the protrusion 28 and back out through the generally rectangular cavity 26 on an opposite side of the protrusion 28.

Referring to FIGS. 3–6, the keeper according to the present invention comprises a back surface 18 having at least one slot 16 disposed therein. The slot 16 comprises a width 32 and a depth 22 which is chosen to provide clearance for a residual protrusion or burr which is commonly found on a hardware-mounting surface of a window extrusion. In the preferred embodiment, the slot 16 comprises a width 32 of about 0.212 inches and a depth 22 of about 0.050 inches. The placement and orientation of the slot 16 is chosen to coincide with a location of residual protrusion or burr on an extrusion surface. The residual protrusion or burr is typically parallel to the length of the extrusion and located at the base of a protrusion or flange where the protrusion or flange typically had previously been largely removed to provide a flat surface against which a flat back surface 18 of a keeper 10 is placed when the keeper is assembled to the extrusion.

The slot 16 according to the present invention may intersect other clearance areas and through holes and thereby comprise more than one slot segment. The keeper according to the preferred embodiment of the present invention comprises a shelled volume 34 having an irregular shape where material is vacated from the back side 18 proximate to and partially intersecting the slot 16. The shelled volume 34 provides reduced material use and more uniform wall thicknesses, which may be favorable for casting or molding operations typically used to fabricate a keeper.

The slot according to the preferred embodiment is divided into segments 16 and 16' due to an intersection of the slot 16 with the shelled volume 34. In the preferred embodiment, the shelled volume 34 is shaped to leave a wall 36 around each mounting screw through hole 12. The slot 16 partially intersects the mounting screw through hole wall 36 and provides a clearance 38 of corresponding material therefrom.

The slot 16 in a keeper according to the preferred embodiment of the invention provides clearance for typical burr associated with removal of a protrusion from any standard window extrusion when mounted in alignment with a mating sash lock.

Having thus described the present invention, it will be understood that the particular devices embodying the invention are shown by way of illustration only and not as limitations of the invention. Hence, the principles and features of this invention may be employed in various and numerous embodiments without departing from the scope of the invention.

I claim:

1. In combination a window sash lock keeper and window sash wherein said keeper comprises:

a substantially planar back surface; and a slot extending at least partially across the substantially planar back surface wherein the slot provides a clearance for a possible burr or residual protrusion on the window sash.

2. The window sash lock keeper of claim 1 further comprising a generally rectangular cavity and at least one mounting screw through hole, wherein the generally rectangular cavity and the at least one mounting screw through hole each extends through the substantially planar back surface of the keeper.

3. The window sash lock keeper of claim 2 further comprising:

at least one beam formed by at least part of a perimeter of the keeper and by the generally rectangular cavity, the at least one beam having a protrusion having dimensions and shape chosen so that the protrusion extends into the generally rectangular cavity and is capable of being captured by a mating sash lock.

4. The window sash lock keeper of claim 3 wherein the linear slot is parallel to the beam.

5. A method of mounting a window sash lock keeper to an extruded window component having a burr or residual protrusion thereon comprising:

providing a clearance slot in a back surface of said keeper wherein said clearance slot comprises a width and depth which are chosen to accept a typical burr or residual protrusion on a mounting surface of the extruded window component;

aligning said keeper and said extruded window component so that said keeper is located to mate properly with a mating window sash lock, said burr or residual protrusion is accepted by said clearance slot and a back surface of said keeper abuts a mounting surface of said extruded window component;

securing said keeper to said extruded window component by mechanical fasteners passing through mounting screw holes in said keeper and through said extruded window component.

6. The method according to claim 5 wherein said mechanical fasteners comprise self-tapping sheet metal screws.

7. In combination a window sash lock keeper and window sash wherein the keeper comprises:

a front surface and a substantially planar back surface; and a slot extending at least partially across the back surface wherein the slot provides clearance for a possible burr or residual protrusion on the window sash, and wherein the slot is located and oriented relative to a mounting position of the keeper and the possible burr or residual protrusion so that the slot is capable of providing clearance for the possible burr or residual protrusion.

8. The window sash lock keeper of claim 7 further comprising:

a generally rectangular cavity extending through the front and back surfaces.

9. The window sash lock keeper of claim 8 further comprising:

at least one beam formed by at least part of a perimeter of the sash lock keeper and at least partially defined by the generally rectangular cavity.

10. The window sash lock keeper of claim 9 wherein the beam comprises a protrusion that extends into the generally rectangular cavity to receive a window sash lock.

11. The window sash lock keeper of claim 9 wherein the slot is parallel to the beam.

12. The window sash lock keeper of claim 7 wherein the front and back surfaces of the keeper together define at least one mounting screw through hole.

13. The window sash lock keeper of claim 12 further comprising:

a shelled volume located on the back surface proximate to and partially intersecting the linear slot.

14. The window sash lock keeper of claim 13 wherein the shelled volume defines at least one internal mounting screw through hole wall surrounding each mounting screw through hole.

15. The window sash lock keeper of claim 14 wherein the slot partially intersects the mounting screw through hole wall.

16. The window sash lock keeper of claim 7 wherein the sash lock keeper is rectangular in shape.

17. The window sash lock keeper of claim 16 wherein the sash lock keeper is a metal alloy casting.

18. The window sash lock keeper of claim 7 wherein the sash lock keeper is a metal alloy casting.

19. The window sash lock keeper of claim 7 wherein the thickness of the keeper is about 0.190 inch.

20. The window sash lock keeper of claim 7 wherein the width of the slot is about 0.212 inch and the depth of the slot is about 0.050 inch.

* * * * *